United States Patent [19]

Tanaka et al.

[11] Patent Number: 4,646,768

[45] Date of Patent: Mar. 3, 1987

[54] EXTENDABLE AND RETRACTABLE CLEANING APPARATUS

[75] Inventors: Yukio Tanaka; Toshiya Miyatake, both of Takasago; Takuya Kitera; Isamu Miyamae, both of Kobe, all of Japan

[73] Assignee: Mitsubishi Jukogyo Kabushiki Kaisha, Tokyo, Japan

[21] Appl. No.: 626,126

[22] Filed: Jun. 29, 1984

[30] Foreign Application Priority Data

Jul. 18, 1983 [JP] Japan ..... 58-110142[U]
Aug. 19, 1983 [JP] Japan ..... 58-127230[U]

[51] Int. Cl.[4] ..... B08B 9/00

[52] U.S. Cl. ..... 134/167 R; 134/172; 92/53

[58] Field of Search ..... 134/124, 129, 166 R, 134/166 C, 167 R, 167 C, 172, 177, 179, 143, 144, 145; 92/2, 52, 53; 52/115, 118, 632; 15/302, 104.1 R; 901/21

[56] References Cited

U.S. PATENT DOCUMENTS

| | | | |
|---|---|---|---|
| 3,585,076 | 6/1971 | Prange | 134/167 C |
| 3,768,578 | 10/1973 | Russell, Jr. | 92/53 X |
| 3,920,084 | 11/1975 | Russell, Jr. | 92/53 X |
| 3,973,468 | 8/1976 | Russell, Jr. | 92/53 X |
| 4,186,911 | 2/1980 | Huet et al. | 92/2 X |
| 4,225,362 | 9/1980 | Sentell . | |
| 4,319,864 | 3/1982 | Kaufeldt | 901/21 X |
| 4,326,317 | 4/1982 | Smith et al. | 15/302 |
| 4,466,307 | 8/1984 | Kouno | 74/479 |
| 4,543,697 | 8/1985 | Poncet | 901/21 X |

FOREIGN PATENT DOCUMENTS

| | | | |
|---|---|---|---|
| 597447 | 5/1930 | Fed. Rep. of Germany | 134/172 |
| 1160439 | 8/1969 | United Kingdom . | |

*Primary Examiner*—Harvey C. Hornsby
*Assistant Examiner*—Frankie L. Stinson
*Attorney, Agent, or Firm*—Wenderoth, Lind & Ponack

[57] ABSTRACT

An extendable and retractable cleaning apparatus includes a multi-stage extendable and retractable arm assembly formed of a plurality of cylindrical members assembled in a telescopic manner, an ejection nozzle provided at a tip end of the innermost cylindrical member of the arm assembly, a mount housing surrounding a substantially central portion of the arm assembly to rotatably support the arm assembly and a casing integrally formed at a base end of the outermost cylindrical member of the arm assembly to form a pressure chamber in cooperation with the assembly. A rotational driving device is provided within the housing for rotationally driving the arm assembly. A washing liquid feed hose is connected to the ejection nozzle. A compressed air feed pipe has one end mounted to the casing to communicate with the pressure chamber. A control device controls the amount and speed of extension and retraction of the arm assembly and includes a perforated metallic belt connected to a base end of the innermost cylindrical member.

8 Claims, 13 Drawing Figures

EXTENDABLE AND RETRACTABLE CLEANING APPARATUS

BACKGROUND OF THE INVENTION

The present invention relates to an extendable and retractable cleaning apparatus, and more particularly, to improvements in a cleaning apparatus suitable for cleaning a header plate and adjacent areas in a steam generator of an atomic power station.

In a known arrangement, when sludge accumulates on a header plate or in the proximity thereof in a steam generator of an atomic power station, such accumulation has to be removed, as shown in FIG. 13, each time by manually mounting a housing 05 adjacent an opening 03 through a steam generator main body 01. A plurality of ejection liquid feed pipes 06 are joined in series to extend from the housing 05 to a position above a central portion of a header plate 04. Washing liquid fed through a washing liquid feed hose 02 connected to the housing 05 passes through the plurality of ejection liquid feed pipes 06 and is ejected from a nozzle 07 at the tip end of the ejection liquid feed pipes 06. Thereby sludge accumulated on a header plate 04 and in the proximity thereof is removed.

In the case of the above-described prior art cleaning apparatus, since it is necessary to manually mount the housing 05 adjacent the opening 03 of the steam generator main body 01 and also to join and extend a plurality of ejection liquid feed pipes 06 each time cleaning is effected, the cleaning operation requires much labor and time, and there is fear that an operator might possibly be exposed to radioactive rays.

SUMMARY OF THE INVENTION

It is therefore one object of the present invention to provide a cleaning apparatus which, once it has been mounted, does not thereafter require manually mounting or dismounting each time cleaning is to be effected.

Another object of the present invention is to provide a cleaning apparatus in which an ejection nozzle can be positioned at a predetermined location and can be retracted from such location by a remote-controlled operation.

Still another object of the present invention is to provide a cleaning apparatus which can achieve excellent cleaning by rotating an ejection nozzle by a remote-controlled operation.

According to one feature of the present invention, there is provided an extendable and retractable cleaning apparatus comprising a multi-stage extendable and retractable arm assembly formed of a plurality of cylindrical members assembled in a telescopic manner, an ejection nozzle provided at a tip end of the innermost cylindrical member of the extendable and contractible arm assembly, a mounting housing surrounding a substantially central portion of the extendable and contractible arm assembly to rotatably support the arm assembly, a casing integrally formed at a base end of the outermost cylindrical member of the arm assembly and defining a pressure chamber, a rotational driving device provided within the housing for rotationally driving the arm assembly, a washing liquid feed hose connected to the ejection nozzle, a compressed air feed pipe having one end mounted to the casing to communicate with the pressure chamber, and an extension and contraction amount control device including a perforated metallic belt connected to a base end of the innermost cylindrical member for performing position control of the ejection nozzle and retraction of the arm assembly.

BRIEF DESCRIPTION OF THE DRAWINGS

The above-mentioned and other features and objects of the present invention will become more apparent by reference to the following description of preferred embodiments of the present invention taken in conjunction with the accompanying drawings, wherein.

DETAILED DESCRIPTION OF THE INVENTION

Figure 1:
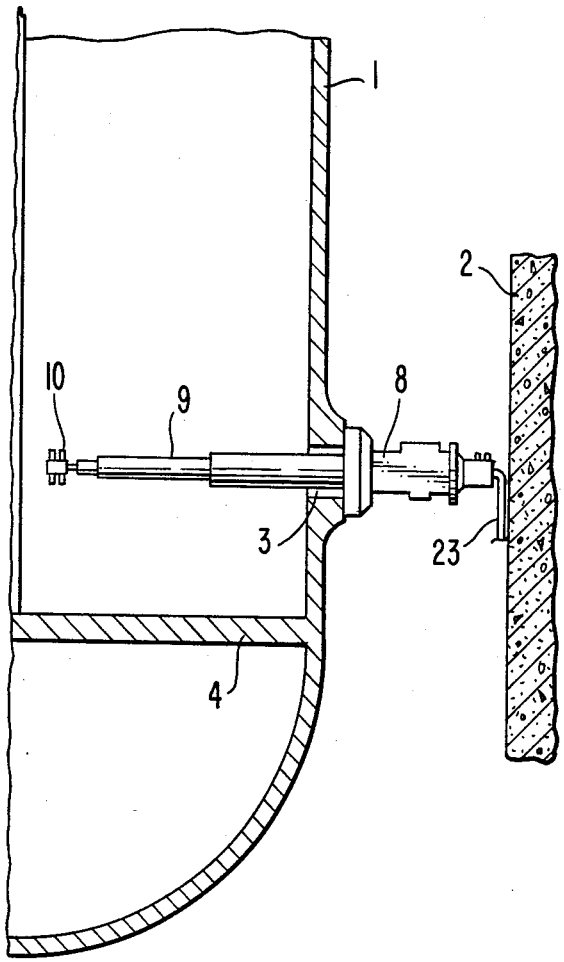
FIGS. 1 through 6 show a first preferred embodiment of a cleaning apparatus according to the present invention, FIG. 1 being a side view, FIG. 2 being a longitudinal cross-sectional side view showing the details of the structure in FIG. 1, FIG. 3 being a transverse cross-sectional rear view taken along line III—III in FIG. 2 as viewed in the direction of the arrows, FIG. 4 being a perspective view showing a feed control pulley, FIG. 5 being a plan view of a perforated metallic belt, and FIG. 6 being a longitudinal cross-sectional view of a hose seal mechanism.

As shown in FIG. 1, a cleaning apparatus 8 according to the present invention is fixedly secured to extend through an opening 3 at a position above a header plate 4, in the space between a steam generator main body 1 and a concrete wall 2. Cleaning apparatus 8 comprises a multi-stage extendable and retractable arm assembly 9, an ejection nozzle 10 and a washing liquid feed hose 23.

Figure 3:
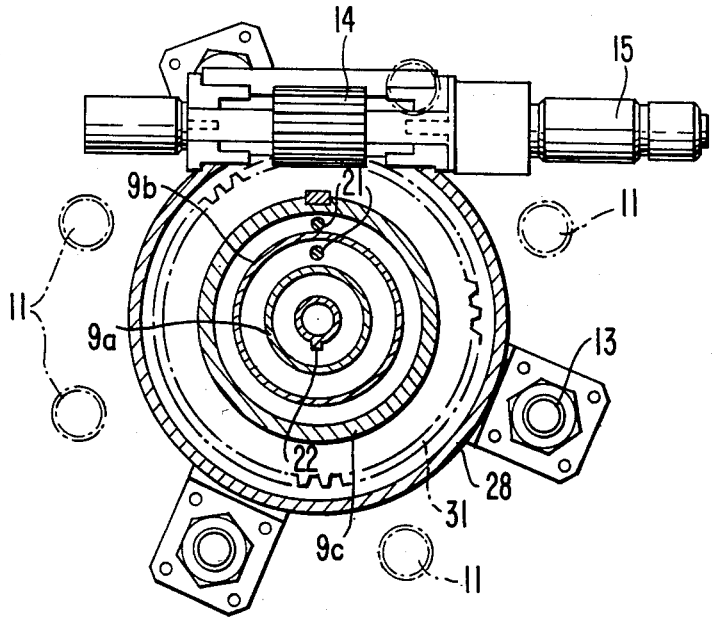
Figure 2:
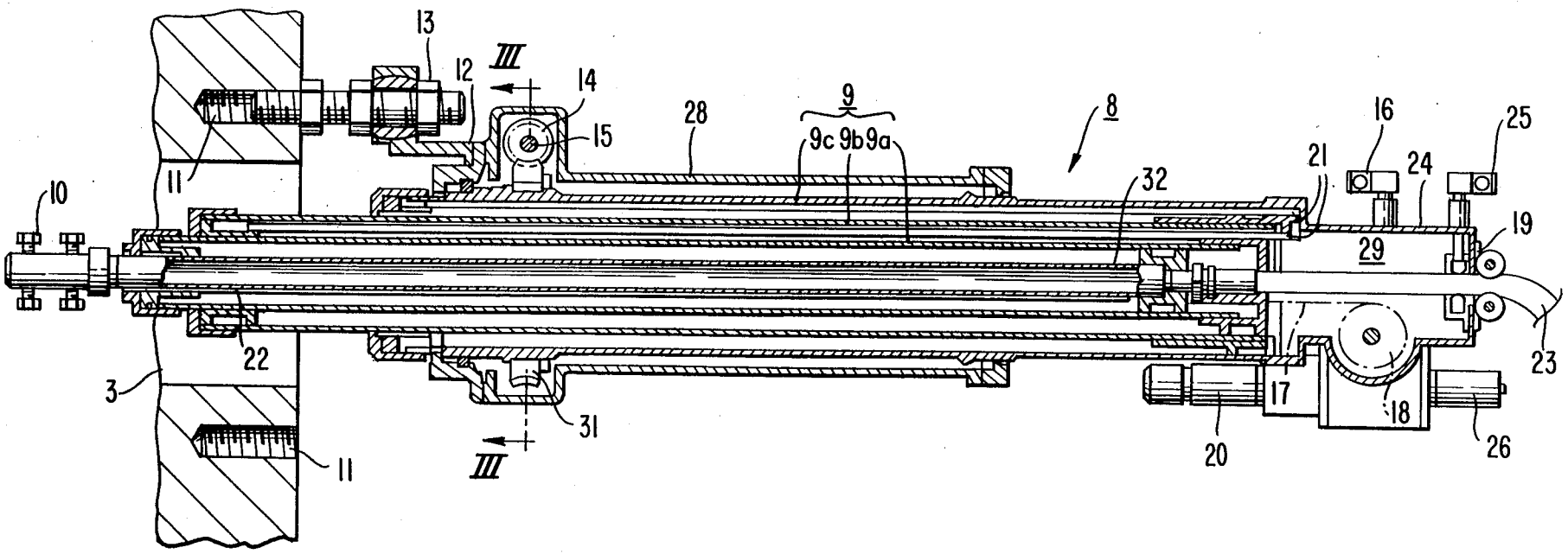
Figure 4:
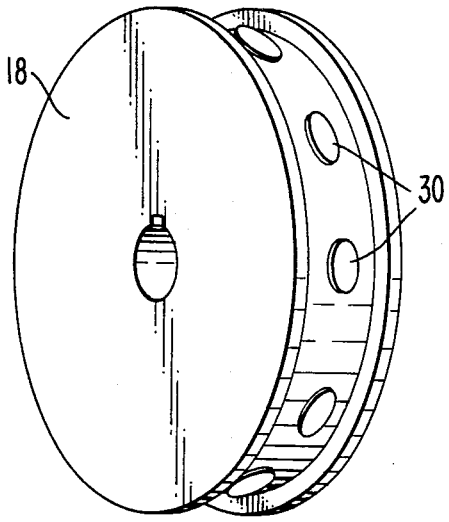
Figure 5:
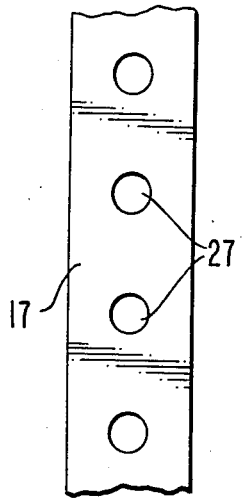
Figure 6:
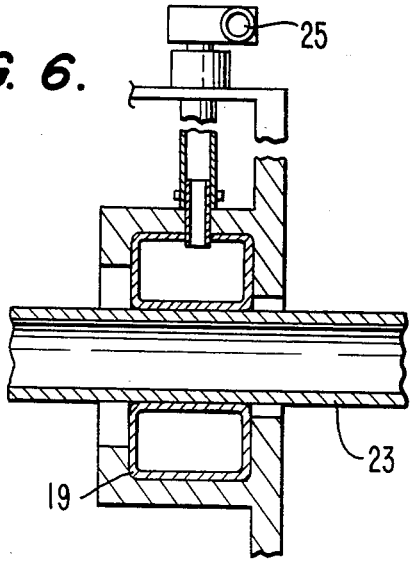

The detailed structure of the cleaning apparatus 8 is shown in FIG. 2. The extendable and retractable arm assembly 9 includes a plurality of cylindrical members **9*a*, 9*b* and 9*c* assembled in a telescopic manner. Arm assembly 9 is rotatably supported by a mounting housing 28 which surrounds a substantially central portion of the arm assembly 9. At a tip end of the innermost cylindrical member 9*a* of the arm assembly 9 is provided an ejection nozzle 10. A casing 24, integrally formed at a base end of the outermost cylindrical member 9*c* of the arm assembly 9, cooperates with the arm assembly 9 to form a pressure chamber 29. As will be apparent from FIG. 3, a driving device 15 such as an electric motor or the like for rotating the arm assembly 9 is provided, and torque from driving device 15 is transmitted via a pinion 14 to a worm 31 fixedly secured to the outer circumference of the outermost cylindrical member 9*c*. As will be best seen in FIG. 6, the washing liquid feed hose 23 is inserted into the casing 24, such as by penetrating through a hose seal mechanism 19 in a sealingly slidable manner, and by feeding compressed air through an air inlet 25 into the hose seal mechanism 19, the hose seal mechanism is brought into tight contact with the washing liquid feed hose 23. A tip end of the washing liquid feed hose 23 is connected to a base end of the innermost cylindrical member 9***a*, and washing liquid fed through this hose 23 is fed to the ejection nozzle 10 through a feed pipe 32 mounted within the innermost cylindrical member 9*a*. Compressed air is fed into the pressure chamber 29 through a compressed air feed pipe 16 one end of which is mounted to the casing 24. To the base end of the innermost cylindrical member 9*a* is connected one end of a perforated metallic belt 17 of an extension and contraction amount control device. As shown in FIGS. 4 and 5, perforated metallic belt 17 is wound around a feed control pulley 18, with holes 27 spaced at equal intervals in the perforated metallic belt 17 engaged with and receiving protrusions 30 provided on a feed control pulley 18. Feed control pulley 18 is rotatably driven by an electric motor 20 which is controlled by an encoder 26, and thereby the amount of extension and contraction of the arm assembly 9, that is, the position of the ejection nozzle 10, can be controlled. The cleaning apparatus 8 is fixedly secured adjacent an opening 3 with the arm assembly 9 held in the most retracted condition, by fastening a mounting member 12 to bolts and nuts 13 which are threadedly inserted into mounting bores 11 for a cover for the opening, as shown in FIG. 2.

The cleaning apparatus 8 operates in the following manner. Compressed air is fed into the pressure chamber 29 through the compressed air feed pipe 16 and acts on the outer end surfaces of the members 9*a*, 9*b* of multi-stage arm assembly 9 to tend to move the respective cylindrical members 9*a*, 9*b* and 9*c* relative to each other and to expand through the opening 3 to the interior of the steam generator main body 1. The speed as well as the amount of movement of the arm assembly 9, and thus of the ejection nozzle 10 provided at the tip end of the innermost cylindrical member 9*a*, can be precisely controlled by controlling the feed speed of the perforated metallic belt 17 connected to the base end of the innermost cylindrical member 9*a* by means of the encoder 26. While the washing liquid feed hose 23 connected to the base end of the innermost cylindrical member 9*a* is pulled into the casing 24 by passing through the hose seal mechanism 19 in accordance with the movement of the innermost cylindrical member 9*a*, air-tightness between the hose seal mechanism 19 and the washing liquid feed hose 23 can be maintained by filling compressed air into the hose seal mechanism 19 through the air inlet 25. Also, since the respective cylindrical members 9*a*, 9*b* and 9*c* are formed to have an air-tight structure and they are assembled with each other in a sealingly slidable manner, the compressed air in the pressure chamber 29 will not leak out. The washing liquid is fed from the washing liquid feed hose 23 through the feed pipe 32 to the ejection nozzle 10 and is ejected from the ejection nozzle 10 toward the header plate 4 and its proximity within the steam generator main body 1, and thereby the washing liquid washes away and removes sludge accumulated on or adhered to these locations. During this operation, if the driving device 15 is rotated and the outermost cylindrical member 9*c* is rotated by $\pm 180°$ about its center axis via the pinion 14 and the worm 31, then the respective cylindrical members 9*a*, 9*b* and 9*c* which are restrained from relative rotation by means of a key 22 or an anti-rotation rod 21, will rotate as a whole. Hence, the ejection nozzle 10 provided at the tip end of the innermost cylindrical member 9*a* will rotate about the center axis, and thereby the washing liquid can be ejected over a wide range.

After the cleaning operation is finished, the multi-stage arm assembly 9 is shortened by discharging the compressed air within the pressure chamber 29 and winding up the perforated metallic belt around the feed control pulley 18, and thus the cleaning apparatus is restored to the position shown in FIG. 2.

By employing the above-described cleaning apparatus 8, the manual operations heretofore required become unnecessary, and it is possible to reduce the possible exposure of the operator to radioactive rays. In addition, the construction of the apparatus can be simplified, because the extension/retraction driving section can be isolated from the rotational driving section by performing extension and retraction by means of compressed air and rotating the arm assembly 9 by means of the electric motor 15, pinion 14 and worm 31. Furthermore, since compressed air is utilized for the purpose of extending and retracting the arm assembly 9, safety can be secured even if the air should leak out, and when the apparatus becomes faulty, recovery of the air is easy. Moreover, as a perforated metallic belt is used for control of the amount of movement of the arm assembly 9, high precision control can be performed even with a remote-controlled operation. Also, since the expandable tube or hose seal mechanism 19 makes use of pneumatic pressure, it is possible to regulate the resistance exerted upon the washing liquid feed pipe 23 by the hose seal mechanism 19. Thus, an excessive load will not be applied to the perforated metallic belt 17. In addition, with regard to the control encoder 26 and the driving motor 20, since the encoder 26 and the motor 20 are disposed outside of the pressure chamber 29 with their shaft portions air-tightly sealed, inspection and maintenance of these parts are facilitated. Due to movement by the force of the compressed air, the sequence of extension or retraction of the respective cylindrical members 9*a*, 9*b* and 9*c* is not limited at all, and thus when passing the arm assembly 9 through a narrow space, even if extension of the outermost cylindrical member 9*c* having the largest diameter is restricted, the cylindrical members 9*a* and/or 9*b* accommodated within the cylindrical member 9*c* may possibly extend in sequence and thus can pass through the narrow space.

Figure 7:
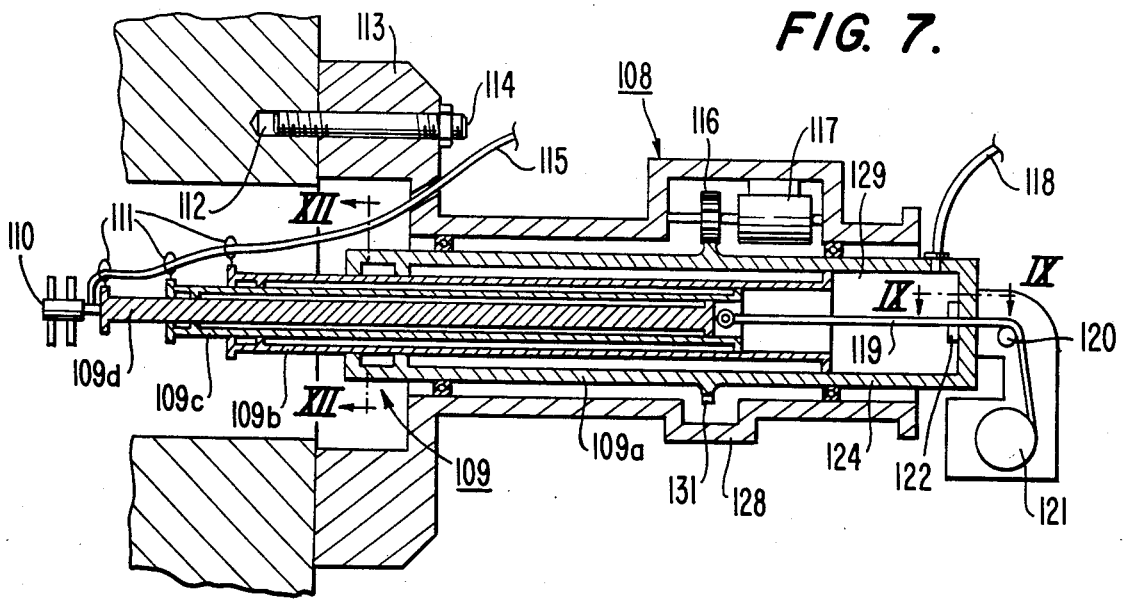
FIGS. 7 through 12 show a second preferred embodiment of a cleaning apparatus according to the present invention, FIG. 7 being a longitudinal cross-sectional side view, FIG. 8 being a longitudinal cross-sectional side view, FIG. 9 being a longitudinal cross-sectional plan view taken along line IX—IX in FIG. 7 as viewed in the direction of the arrows, FIG. 10 being a rear view as viewed in the direction of an arrow X in FIG. 9, FIG. 11 being a perspective view showing a metallic belt winding reel, and FIG. 12 being a transverse cross-sectional view taken along line XII—XII in FIG. 7 as viewed in the direction of the arrows.
Figure 8:
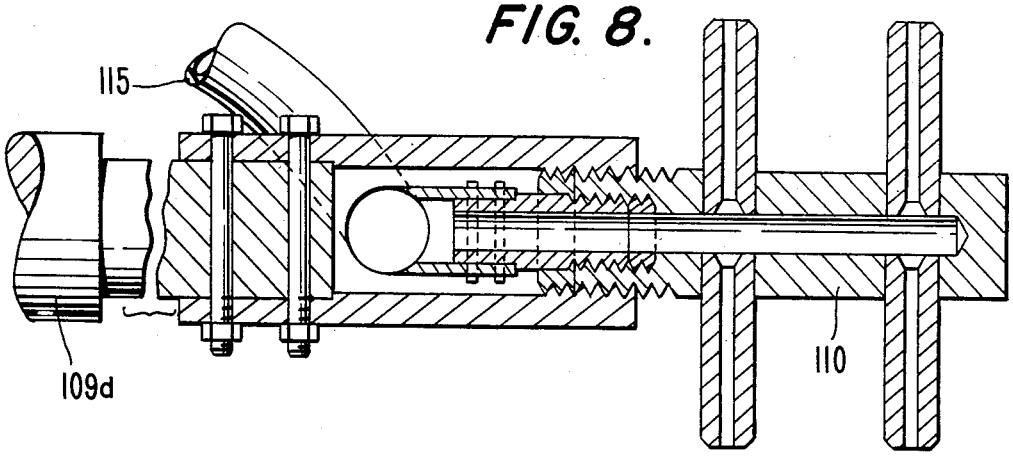
Figure 9:
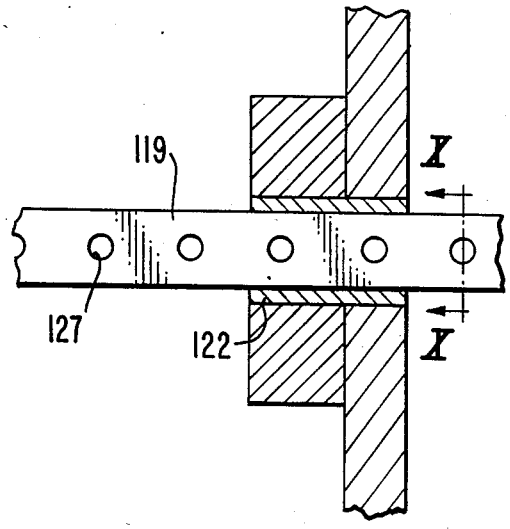
Figure 10:
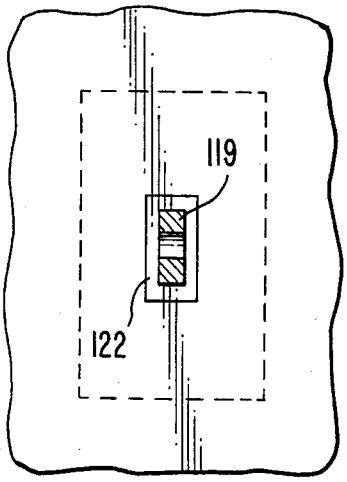
Figure 11:
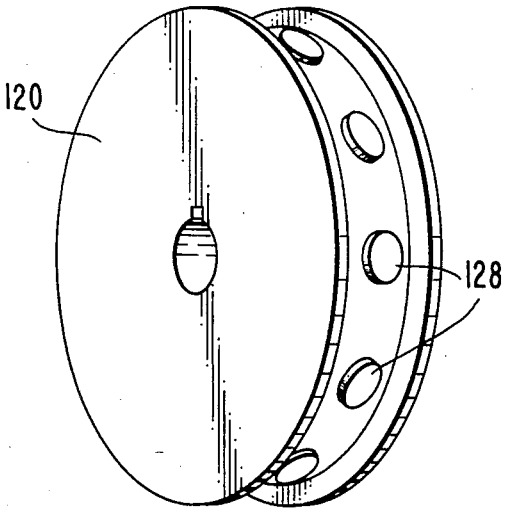
Figure 12:
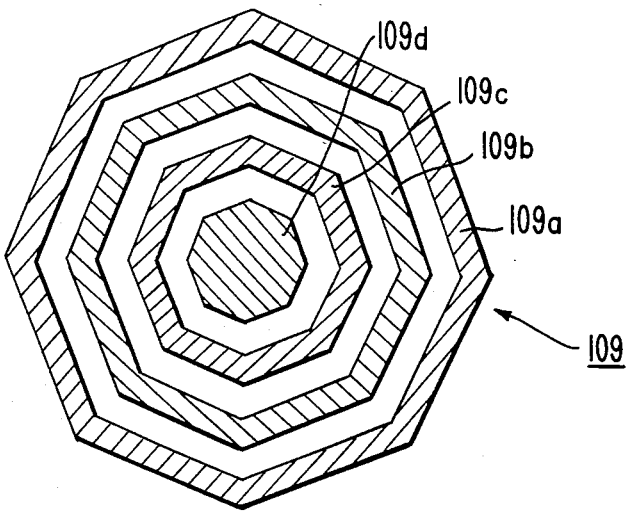
Figure 13:
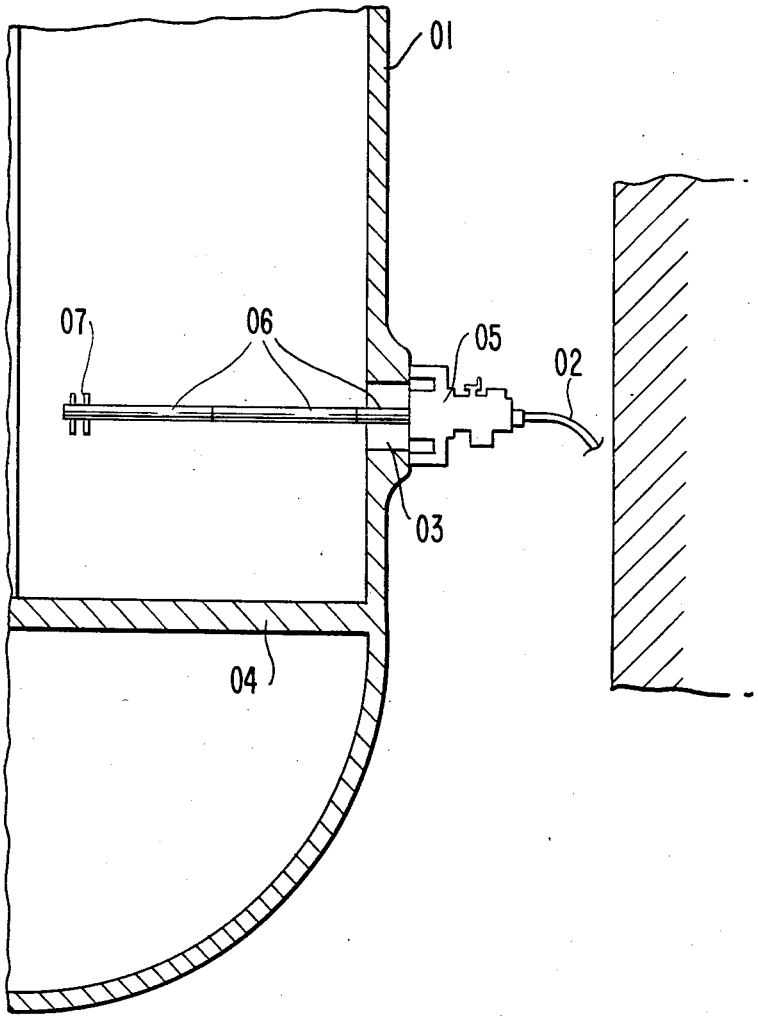
FIG. 13 is a side view showing a prior art cleaning apparatus.

Another preferred embodiment of the present invention is illustrated in FIGS. 7 through 12. The illustrated cleaning apparatus 108 also comprises a multi-stage extendable and retractable arm assembly 109 which consists of a plurality of cylindrical members 109*a*, 109*b*, 109*c* and 109*d* assembled in a telescopic manner. The respective cylindrical members 109*a*, 109*b*, 109*c* and 109*d* have a polygonal cross-section shape as shown in FIG. 12, and while they are allowed to make relative movement in the axial direction in a sealingly slidable manner, they are restrained from relative rotation. The innermost cylindrical member 109*d* is made solid. Arm assembly 109 is rotatably supported by a mounting housing 128 which surrounds a substantially central portion of the arm assembly 109. At a tip end of the innermost cylindrical member 109*d* is provided an ejection nozzle 110 as shown in FIG. 8. A washing liquid feed hose 115 penetrates through the mounting housing 128, is connected to the ejection nozzle 110 and is guided by guide members 111. A casing 124 integrally formed at a base end of the outermost cylindrical member 109*a*, forms a pressure chamber 129 in cooperation with the arm assembly 109. Within the mounting housing 128 is provided a driving device 117 such as an electric motor or the like for rotating the arm assembly 109, and the torque of driving device 117 is transmitted via a gear 116 fixedly secured to its shaft to a gear 131 provided on the outer periphery of the outermost cylindrical member 109*a*. Compressed air is fed into the pressure chamber 129 through a compressed air feed pipe 118, one end of which is connected to the casing 124. To the base end of the innermost cylindrical member 109*d* is connected an extension and retraction amount control device. Perforated metallic belt 119 passes from casing 124 through a seal mechanism 122 in an air-tightly slidable manner as shown in FIGS. 9 and 10. Belt 119 passes around a pulley 120 having protrusions 128 adapted to engage with holes 127 in belt 119 as shown in FIG. 11 and is taken up by a reel 121. The cleaning apparatus 108 is fixedly secured in the condition where the arm assembly 109 is most shortened, by threadedly inserting bolts 114 penetrating through a mounting member 113 into mounting bores 112 for a cover for the opening, as shown in FIG. 7.

The multi-stage arm assembly 109 is extended by feeding compressed air into the pressure chamber 129 through the compressed air feed pipe 118, thus acting on outer end surfaces of members 109*b*, 109*c*, 109*d*, and the speed of the amount and such extension are precisely controlled by controlling the speed and amount of feed movement of the perforated metallic belt 119. Washing liquid is fed to the ejection nozzle 110 through washing liquid feed hose 115. Ejection nozzle 110 is rotated about its center axis by actuating the driving device 117, and thereby the washing liquid ejected from the ejection nozzle 110 washes away sludge adhered to or accumulated on the header plate or in its proximity.

After cleaning is finished, the multi-stage arm assembly 109 is retracted by discharging the compressed air from the pressure chamber 129 and taking up the perforated metallic belt 119 onto the reel 121.

Since many changes and modifications can be made to the above-described construction without departing from the spirit of the present invention, it is intended that all matter contained in the above description and illustrated in the accompanying drawings shall be interpreted to be illustrative and not as a limitation to the scope of the invention.

What is claimed is:

1. A cleaning apparatus for cleaning an interior of a shell structure, said apparatus comprising:

a mounting housing to be mounted removably on the shell structure;

an outermost cylindrical member surrounded substantially at a central portion thereof by said mounting housing, said outermost cylindrical member being rotatable about a longitudinal axis thereof with respect to said mounting housing but fixed axially with respect thereto;

a plurality of inner cylindrical members including an innermost cylindrical member mounted within and supported by said outermost cylindrical member in a telescopic manner with respect to each other and to be protrudable from and retractable into said outermost cylindrical member;

a casing integral with a rearward end of said outermost cylindrical member and defining with rearwardly facing rearward ends of said inner cylindrical members a pressure chamber;

an ejection nozzle facing radially outwardly and provided at a forward end of the innermost of said inner cylindrical members;

a washing liquid feed hose connected to said ejection nozzle for ejecting washing liquid therefrom;

means within said housing for rotating said outermost cylindrical member and said inner cylindrical members about said longitudinal axis and thereby for controlling the direction of ejection of washing liquid from said nozzle;

means for selectively supplying compressed air into said pressure chamber to act on said rearwardly facing rearward ends and thereby for longitudinally protruding said inner cylindrical members from said outermost cylindrical member and with respect to each other, and selectively exhausting said compressed air from said pressure chamber; and control means for regulating the amount of protruding movement of said inner cylindrical members upon supply of said compressed air into said pressure chamber, and for restracting said inner cylindrical members into said outermost cylindrical member and with respect to each other, thereby controlling the longitudinal position of said nozzle, said control means comprising a belt connected to a rearward end of said innermost inner cylindrical member, said belt having therein spaced perforations, and means engaging said perforations for alternately allowing regulated longitudinal movement of said belt and said innermost inner cylindrical member.

2. An apparatus as claimed in claim 1, wherein said feed hose slidably extends through said mounting housing, and said innermost inner cylindrical member is solid without a passage therethrough.

3. An apparatus as claimed in claim 1, wherein said innermost inner cylindrical member is hollow, and further comprising a feed pipe fixed to and extending through said innermost inner cylindrical member, said feed pipe having a forward end connected to said nozzle and a rearward end, and said feed hose extends through a wall of said casing and through said pressure chamber and is connected to said rearward end of said feed pipe.

4. An apparatus as claimed in claim 3, further comprising means for sealing said feed hose with respect to said casing wall while enabling sliding movement of said feed hose with respect to said casing wall.

5. An apparatus as claimed in claim 4, wherein said sealing means comprises an expandable tube mounted within said casing wall, with said feed hose passing through said tube, and means for supplying compressed air into said tube to expand said tube into sealing contact with said feed base.

6. An apparatus as claimed in claim 1, wherein said belt comprises a metallic belt.

7. An apparatus as claimed in claim 1, wherein said control means comprises a pulley mounted within said casing, said pulley having protrusions engaging said perforations in said belt, a motor for rotating said pulley in opposite directions, and encoder means for controlling operation of said motor.

8. An apparatus as claimed in claim 1, wherein said belt sealingly extends through a wall of said casing, and said control means comprises a pulley mounted outside of said casing, said pulley having protrusions engaging said perforations in said belt, a reel for taking up said belt, a motor for rotating said pulley in opposite directions, and encoder means for controlling operation of said motor.

* * * * *